US009790637B2

(12) United States Patent
Kim et al.

(10) Patent No.: US 9,790,637 B2
(45) Date of Patent: Oct. 17, 2017

(54) WASHING MACHINE AND METHOD OF MANUFACTURING DOOR THEREOF

(71) Applicant: SAMSUNG ELECTRONICS CO., LTD., Suwon-si, Gyeonggi-do (KR)

(72) Inventors: Jae Young Kim, Busan (KR); Han Kyu Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 195 days.

(21) Appl. No.: 14/493,931

(22) Filed: Sep. 23, 2014

(65) Prior Publication Data

US 2015/0123520 A1 May 7, 2015

(30) Foreign Application Priority Data

Nov. 7, 2013 (KR) ..... 10-2013-0134966

(51) Int. Cl.
*D06F 39/14* (2006.01)
*E05D 7/00* (2006.01)
*E05D 15/00* (2006.01)

(52) U.S. Cl.
CPC ..... *D06F 39/14* (2013.01); *E05D 7/00* (2013.01); *E05D 15/00* (2013.01); *Y10T 29/49826* (2015.01)

(58) Field of Classification Search
CPC . D06F 39/14; D06F 37/28; E05D 7/00; E05D 15/00; Y10T 29/49826
See application file for complete search history.

(56) References Cited

U.S. PATENT DOCUMENTS

2006/0117809 A1* 6/2006 Ha ..... D06F 37/28 68/3 R
2006/0117813 A1* 6/2006 Ha ..... D06F 39/14 68/196
2007/0017258 A1* 1/2007 Son ..... D06F 39/14 68/3 R
2009/0165391 A1* 7/2009 Kocak ..... D06F 39/14 49/480.1

(Continued)

FOREIGN PATENT DOCUMENTS

DE 10 2006 03002 2/2007
DE 10 2009 047595 6/2011

(Continued)

OTHER PUBLICATIONS

European Extended Search Report dated Mar. 10, 2015 from European Patent Application No. 14188834.7, 7 pages.

(Continued)

*Primary Examiner* — Joseph L Perrin
(74) *Attorney, Agent, or Firm* — Staas & Halsey LLP

(57) ABSTRACT

A washing machine having a door with an improved structure may include a cabinet, a laundry port, a tub that is disposed in the cabinet, a drum that is disposed in the tub, and a door that opens and closes the laundry port. The door may include a door cover placed at an outer side of the door when the door closes the laundry port, and a decoration member coupled to the door cover so that at least a portion of the decoration member is projected onto the door cover. The door having the improved structure may be manufactured without the necessity of performing post-processing and a molding cost may be reduced.

22 Claims, 9 Drawing Sheets

(56) References Cited

U.S. PATENT DOCUMENTS

| | | | | |
|---|---|---|---|---|
| 2010/0031581 | A1* | 2/2010 | Kang | D06F 39/14 49/507 |
| 2011/0006649 | A1* | 1/2011 | Caudevilla De Sola | D06F 37/28 312/228 |
| 2012/0086315 | A1* | 4/2012 | Da Riol | D06F 39/14 312/228 |

FOREIGN PATENT DOCUMENTS

| | | |
|---|---|---|
| EP | 2161364 | 3/2010 |
| EP | 2243874 | 10/2010 |
| WO | WO 2006/009363 | 1/2006 |

OTHER PUBLICATIONS

European Office Action dated Jan. 24, 2017 from European Patent Application No. 14188834.7, 30 pages.

* cited by examiner

WASHING MACHINE AND METHOD OF MANUFACTURING DOOR THEREOF

CROSS-REFERENCE TO RELATED APPLICATIONS

This application claims the benefit of Korean Patent Application No. 10-2013-0134966, filed on Nov. 7, 2013 in the Korean Intellectual Property Office, the disclosure of which is incorporated herein by reference.

BACKGROUND

1. Field

Embodiments disclosed herein relate to a washing machine and a method of manufacturing a door of the washing machine, and more particularly, to a washing machine having a door with an improved structure.

2. Description of the Related Art

A washing machine generally refers to a machine that washes laundry using power. For example, washing machines may generally be classified as a pulsator type washing machine and a drum type washing machine according to a washing method. The drum type washing machine may include a cabinet, a tub provided in the cabinet so as to accommodate washing water, a drum that is rotatably installed in the tub, a motor for rotating the drum, and a door that opens and closes an opening.

In the drum type washing machine, washing may be performed by rotating drum which consequently causes the laundry to fall by the force of gravity, for example. A lifter may be disposed in the drum so as to lift the laundry in an upward direction.

The door may include a door cover that constitutes an exterior, glass that protrudes toward an inside of the washing machine, and a glass holder that fixes the glass.

Recently, decorative elements may be added to the door cover so as to provide a beautiful design and to discriminate between the door cover and the cabinet. In the related art, post-processing, such as color spray, chrome plating, bonding, or the like, is performed for these decorative elements. This causes waste water and pollutants, which is not eco-friendly and causes an increase in manufacturing costs due to post-processing.

SUMMARY

Therefore, it is an aspect of the disclosure to provide a washing machine including a door that is capable of (configured to, suitable for, adapted to, arranged to, operable to, etc.) giving a change in a decoration characteristic by improving a structure of a door cover of the door, and a method of manufacturing the door of the washing machine.

Additional aspects of the disclosure will be set forth in part in the description which follows and, in part, will be apparent from the description, or may be learned by practice of the disclosure.

In accordance with an aspect of the disclosure, there is provided a washing machine which may include a cabinet having a laundry port, a tub that is disposed in the cabinet and is capable of (configured to, suitable for, adapted to, arranged to, operable to, etc.) accommodating washing water, a drum that is disposed in the tub and is capable of (configured to, suitable for, adapted to, arranged to, operable to, etc.) accommodating laundry, and a door that opens and closes the laundry port. The door may include: a door cover placed at an outer side of the door when the door closes the laundry port, and a decoration member coupled to the door cover so that at least a portion of the decoration member is capable of (configured to, suitable for, adapted to, arranged to, operable to, etc.) being projected onto the door cover.

The door cover may further include a first portion formed of a transparent material and a second portion formed of an opaque material and projected onto the first portion.

The decoration member may be coupled to the first portion in such a way that at least a portion of the decoration member overlaps the first portion.

The decoration member may be coupled to a rear surface of the door cover.

The first portion may include a first region coupled to the second portion so that the second portion can be projected onto the first portion, and a second region that is not coupled to the second portion, and the second region may be farther away from a center of the door cover than the first region.

At least a portion of the decoration member may be projected onto the door cover through the second region.

A hook may be provided at the decoration member, and a hook coupling portion may be provided at a rear surface of the door cover, and the decoration member and the door cover may be coupled to each other by coupling between the hook and the hook coupling portion.

An additional fastening member may be coupled to a fastening member coupling portion provided at the decoration member so that the decoration member and the door cover can be coupled to each other.

A plurality of uneven structures may be provided at at least a portion of the decoration member.

The door may further include: glass placed in a center of the door, and a glass holder coupled between the door cover and the glass.

In accordance with an aspect of the disclosure, there is provided a washing machine which may include a cabinet that constitutes an exterior and has a laundry port, a tub that is disposed in the cabinet and is capable of (configured to, suitable for, adapted to, arranged to, operable to, etc.) accommodating washing water, a drum that is disposed in the tub and is capable of (configured to, suitable for, adapted to, arranged to, operable to, etc.) accommodating laundry, and a door that opens and closes the laundry port. The door may include: a door cover including a first portion configured (suitable for, capable of, adapted to, arranged to, operable to, etc.) so that light passes through at least a portion of the door cover and a second portion provided to be projected onto the first portion, and a decoration member coupled to a rear surface of the door cover so as to be projected onto the door cover through the first portion.

The second portion may be placed closer to a center of the door cover than the first portion.

A distance between the decoration member and the center of the door cover may be shorter than a distance between the first portion and the center of the door cover and may be longer than a distance between the second portion and the center of the door cover.

The decoration member may be provided in a ring shape.

The first portion may include a first region coupled to the second portion and a second region that is not coupled to the second portion.

A plurality of uneven structures may be provided at at least a portion of the decoration member, and the plurality of uneven structures may be projected through the first portion.

In accordance with an aspect of the disclosure, there is provided a method of manufacturing a door of a washing machine, in which the method may include manufacturing a door cover by performing first injection molding on a first portion configured (suitable for, capable of, adapted to, arranged to, operable to, etc.) so that incident light is allowed (enabled) to pass through the first portion and by performing secondary injection molding on a second portion which is placed at an inner side of the first portion and of which at least a portion is projected through the first portion, and coupling a decoration member of which at least a portion is projected through the first portion, to the door cover.

The method may further include, after the coupling of the door cover and the decoration member, coupling glass.

A glass holder for fixing the glass may be coupled to the door cover.

The coupling of the decoration member and the door cover may be performed using a hook provided at at least one of the decoration member and the door cover.

In accordance with an aspect of the disclosure, there is provided a washing machine which may include a cabinet having a laundry port, a tub disposed in the cabinet, a drum disposed in the tub, and a door that opens and closes the laundry port. The door may include a door cover disposed at an outer side of the door when the door is closed, the door cover including a first portion formed of a transparent material, and a second portion formed of an opaque material, and a decoration member connected to a rear surface of the door cover, and being partially visible from the outer side of the door when the door is closed.

The first portion may be formed as a ring-shaped object, the second portion may be formed as a ring-shaped object having a smaller diameter than a diameter of the first portion, and the decoration member may be formed as a ring-shaped object and may partially overlap the first portion. The first portion may include an inclination portion formed at an outer circumferential edge of the first portion, inclined toward an outer side of the door, a first region coupled to the second portion, the second portion being visible through the first region, and a second region disposed between the inclination portion and the first region to scatter light incident from outside the washing machine and connected to the decoration member.

In accordance with an aspect of the disclosure, there is provided an electronic appliance including a cabinet forming an exterior of the electronic appliance, and a door installed on a surface of the cabinet, the door adapted to open and close to provide access to an interior of the cabinet. The door may include a door cover disposed at an outer side of the door when the door is closed, the door cover including a first portion formed of a transparent material, and a second portion formed of an opaque material, a decoration member connected to a rear surface of the door cover, and being partially visible from the outer side of the door when the door is closed, and a glass holder coupled to the door cover on one side of the glass holder, and coupled to a glass structure on the other side of the glass holder.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
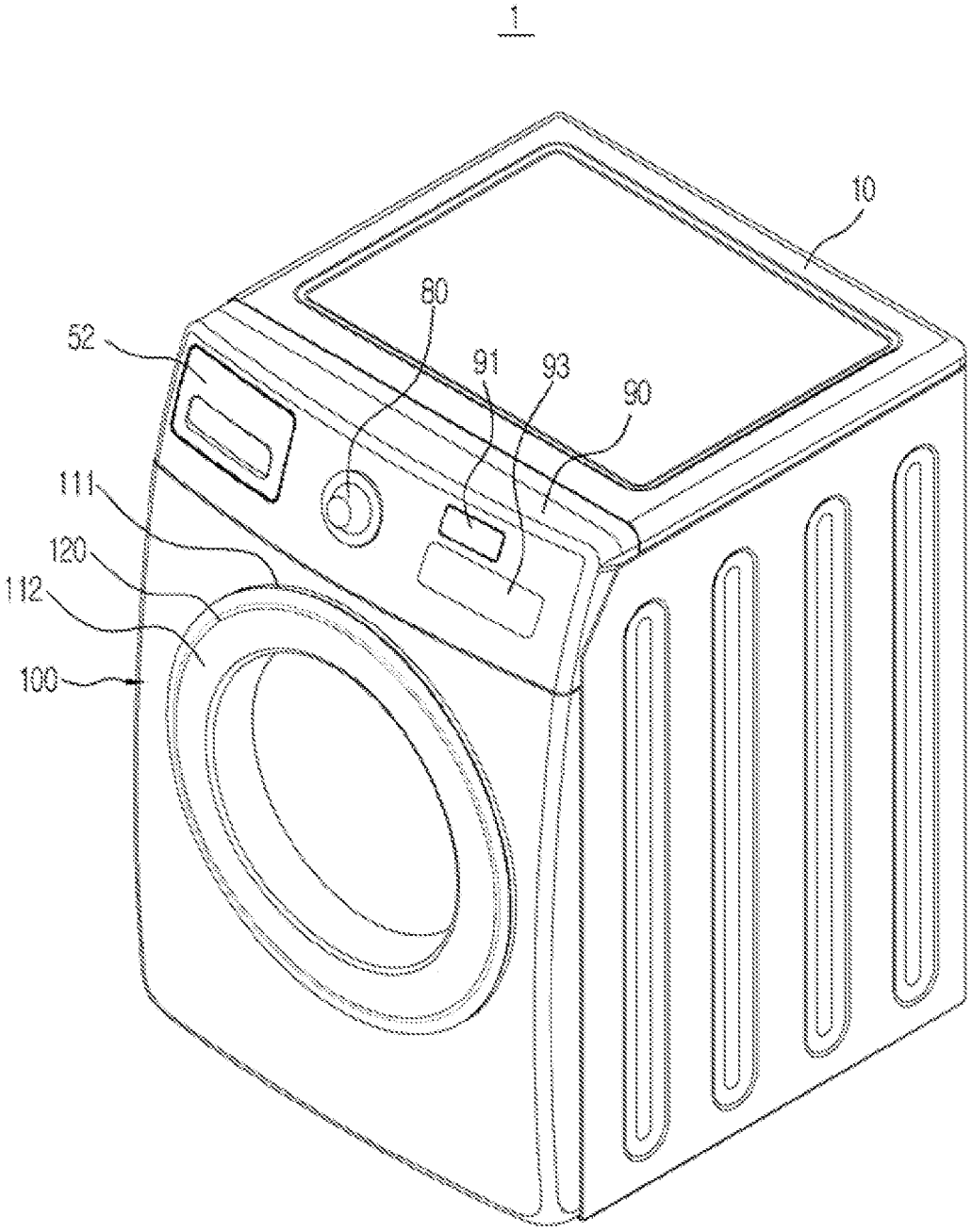
FIG. 1 is a perspective view of a washing machine according to an embodiment of the disclosure.

Reference will now be made in detail to the embodiments of the disclosure, examples of which are illustrated in the accompanying drawings, wherein like reference numerals refer to like elements throughout. Hereinafter, a drum washing machine will be described as an example of a washing machine. However, embodiments of the disclosure are not limited thereto.

Figure 2:
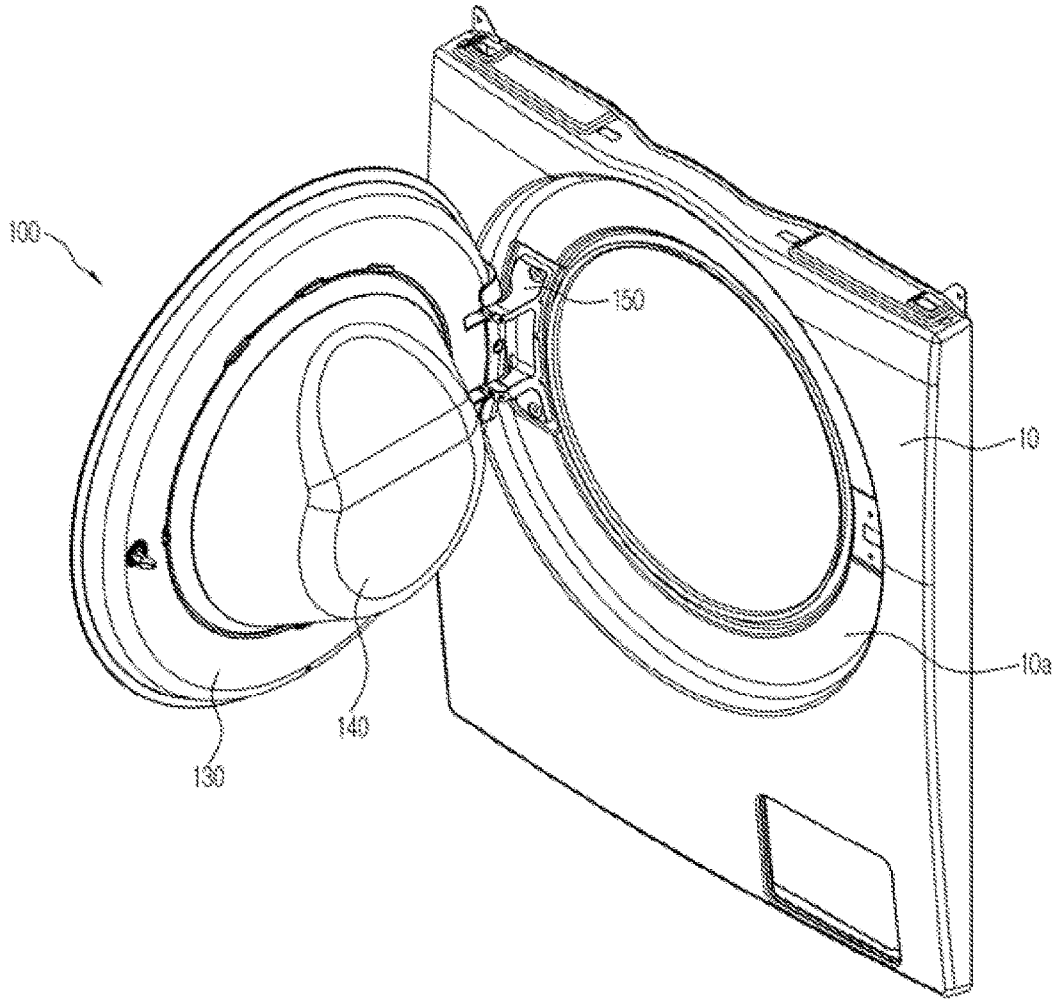
FIG. 2 is a perspective view illustrating a state in which a door of the washing machine illustrated in FIG. 1 is opened.
Figure 3:
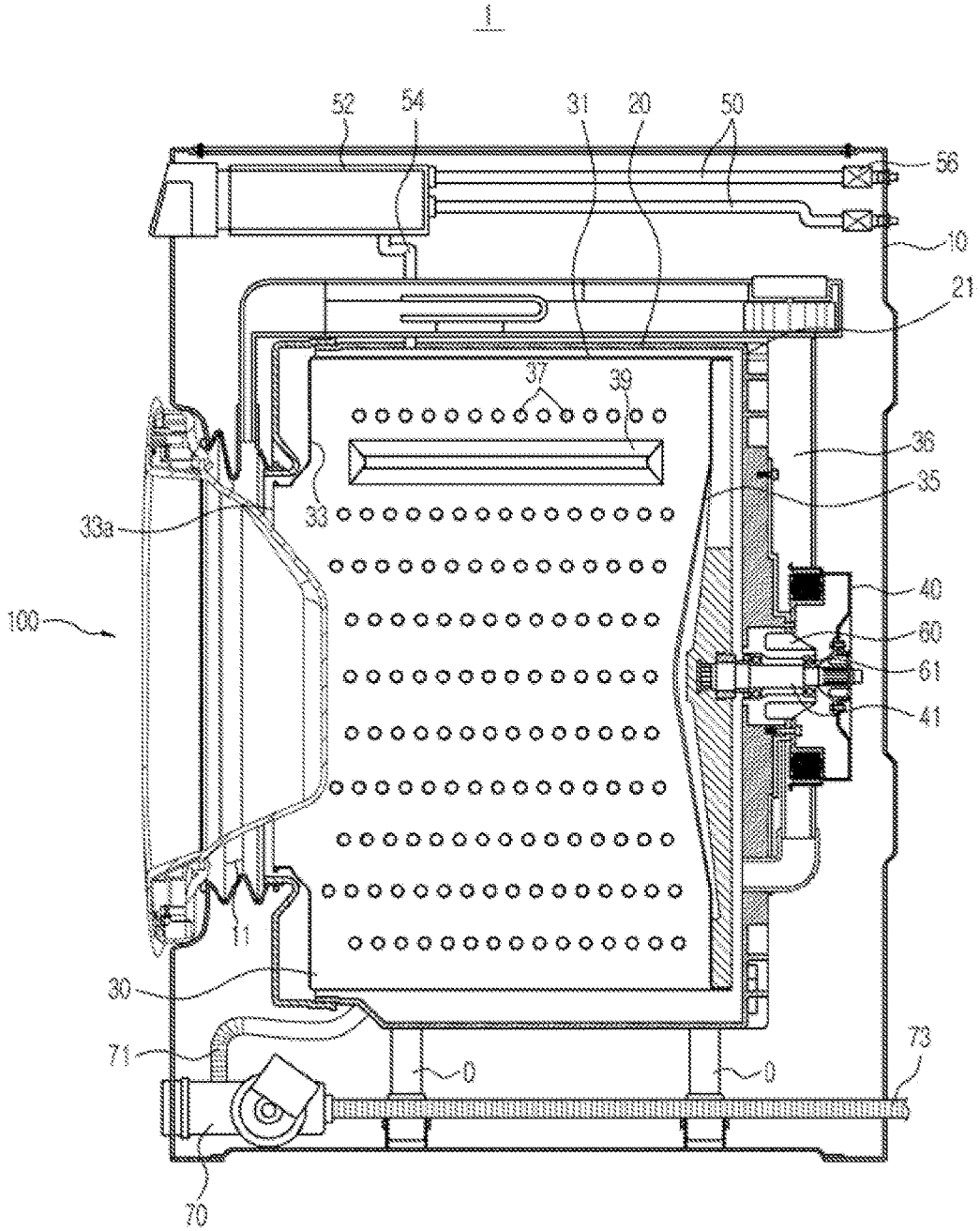
FIG. 3 is a cross-sectional view of the washing machine of FIG. 1.

FIG. 1 is a perspective view of a washing machine according to an embodiment of the disclosure, and FIG. 2 is a perspective view illustrating a state in which a door of the washing machine illustrated in FIG. 1 is opened, and FIG. 3 is a cross-sectional view of the washing machine of FIG. 1.

As illustrated in FIGS. 1 through 3, a washing machine 1 may include a cabinet 10 that constitutes an exterior, a tub 20 disposed in the cabinet 10, a drum 30 that is rotatably disposed in the tub 20, and a motor 40 that drives the drum 30.

A laundry port (opening) 11 through which laundry may be put into the drum 30, may be formed on a front portion of the cabinet 10. The laundry port 11 may be opened and closed by a door 100 installed at a front surface of the cabinet 10.

A concave portion 10*a* may be provided at at least a portion of the cabinet 10 that the door 100 contacts when the door 100 closes the laundry port 11 and may be recessed into the washing machine 1. The concave portion 10*a* may be formed along edges of the laundry port 11. Also, the concave portion 10*a* may be provided to correspond to a shape of the door 100. Thus, the door 100 may be coupled to the concave portion 10*a* when the door 100 is closed, and a portion of the door 100 which protrudes toward a surface of the cabinet 10 can be reduced (e.g. so that an outer surface of the door 100 is substantially or approximately flush with the cabinet 10).

When viewing or perceiving the door 100 from an outside of the washing machine 1, the door 100 may include a first portion 111 that is formed transparently, a second portion 112 that is provided opaquely, and a decoration member 120 provided between the first portion 111 and the second portion 112. The first portion 111 may be farthest from a center of the door 100, and the decoration member 120 may be placed at an inner side of the first portion 111, and the second portion 112 may be placed at the inner side of the first portion 111. The door 100 will be described later.

A water supply pipe 50 for supplying washing water to the tub 20 may be installed at an upper portion of the tub 20, and one side of the water supply pipe 50 may be connected to a water supply valve 56, and the other side of the water supply pipe 50 is connected to a detergent box 52.

The detergent box 52 may be connected to the drum 30 via a connection pipe 54, and water supplied via the water supply pipe 50 may pass through the detergent box 52 and may be supplied into the drum 30 together with detergent.

The tub 20 may be supported by one or more dampers D. The one or more dampers D may connect a bottom surface inside the cabinet 10 and an outer surface of the tub 20.

The drum 30 may include a cylindrical portion 31, a front portion 33 disposed in front of the cylindrical portion 31, and a rear portion 35 disposed behind the cylindrical portion 31.

An opening 33*a* through which the laundry is put into or taken out from the drum 30, may be formed in the front portion 33, and a driving shaft 41 for transmitting power of the motor 40 may be connected to the rear portion 35.

A plurality of through holes 37 through which washing water flows, may be formed in a circumference of the drum 30, and a plurality of lifters 39 may be installed on an inner circumferential surface of the drum 30 so that the laundry can be lifted or dropped when the drum 30 rotates.

The driving shaft 41 may be disposed between the drum 30 and the motor 40, and one end of the driving shaft 41 may be connected to the rear portion 35 of the drum 30, and the other end of the driving shaft 41 may extend to an outer side of a rear wall 21 of the tub 20.

When the motor 40 connects the driving shaft 41 to the drum 30, the drum 30 connected to the driving shaft 41 may rotate around the driving shaft 41.

A bearing housing 60 may be installed at a rear wall of the tub 20 so as to rotatably support the driving shaft 41.

The bearing housing 60 may be formed of an aluminum alloy and may be inserted into the rear wall of the tub 20 when the tub 20 is injection molded.

Bearings 61 may be installed between the bearing housing 60 and the driving shaft 41 so that the driving shaft 41 may be smoothly rotated.

A drainage pump 70 for discharging water in the tub 20 to an outside of the washing machine 1, a connection hose 71 that connects the tub 20 and the drainage pump 70 so that water in the tub 20 may be introduced into the drainage pump 70, and a drainage hose 73 that guides water pumped by the drainage pump 70 to the outside of the washing machine 1, may be provided below the tub 20.

A drying unit 36 that dries air in the tub 20 and then supplies dried air into the tub 20 again, may be mounted on the tub 20.

A control panel 90 may include a display window 93 through which light emitted from a graphic display (not shown) may be transmitted so that a user may check the light, and an operating unit 91 through which the user may select an option so as to control an operation of the washing machine 1. For example, the operating unit may be provided at an upper portion of the front surface of the cabinet 10.

The graphic display (not shown) may indicate thereon which option has been selected by the user so as to control one or more operations of the washing machine 1. For example, the graphic display may be provided on a rear surface of the control panel 90.

At least one knob 80 may be provided on the control panel 90. The knob 80 may be rotated and may control whether and how the washing machine 1 operates or not, or a degree, duration, and/or intensity of operation of the washing machine 1.

Figure 4:
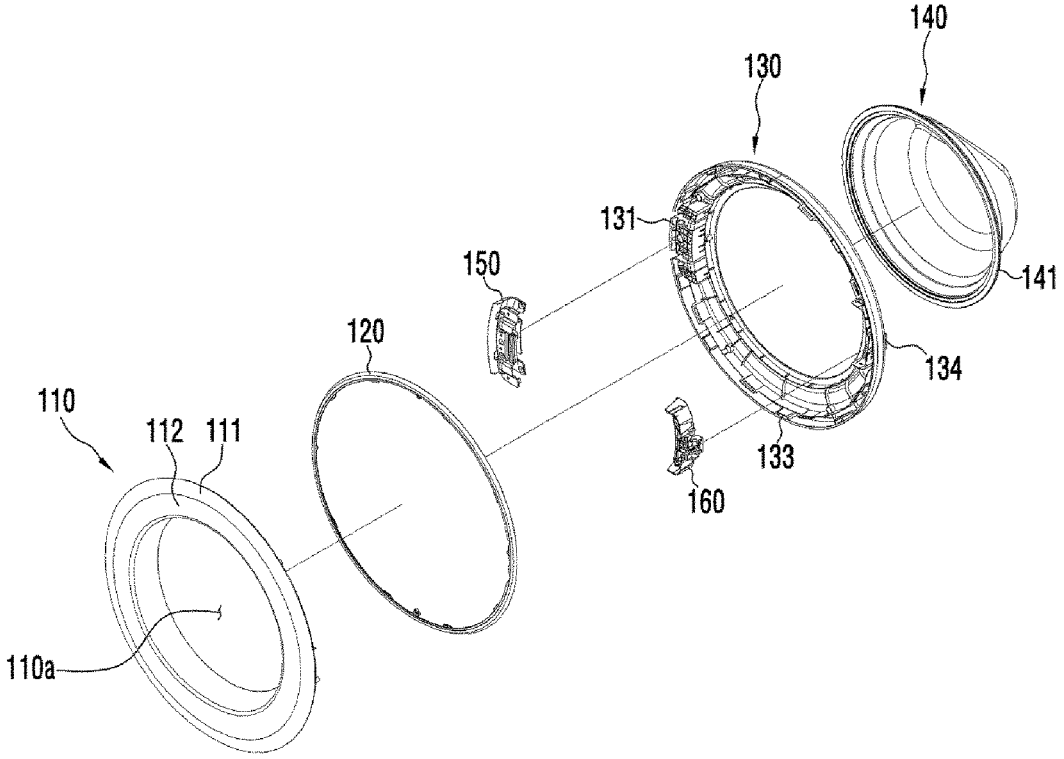
FIG. 4 is an exploded view of a door according to an embodiment of the disclosure.

FIG. 4 is an exploded view of a door according to an embodiment of the disclosure.

As illustrated in FIG. 4, the door 100 may include a door cover 110 placed at the outermost side of the door 100, glass 140 that protrudes toward an inside of the washing machine 1, and a glass holder 130 that is coupled to the door cover 110 and supports the glass 140. The door 100 further may include a decoration member 120 coupled to the door cover 110 so that at least a portion of the decoration member 120 may be projected onto the door cover 110.

The door cover 110 and the decoration member 120 may be coupled to each other, and the glass 140 may be coupled to the decoration member 120. The glass holder 130 may be coupled to the door cover 110 so as to couple the glass 140 to the decoration member 120.

The first portion 111 of the door cover 110 may be formed of a transparent material, and the second portion 112 may be formed of an opaque material. For example, the second portion 112 may be formed of a colored, opaque material. For example, the first portion 111 may be formed of at least one plastic material of polymethyl methacrylate (PMMA) and polycarbonate (PC). The second portion 112 may be formed of acrylonitrile butadiene styrene copolymer (ABS).

According to an embodiment of the disclosure, the door 100 may be provided in a circular shape. However, embodiments of the disclosure are not limited thereto. For example, the door 100 may be provided in another shape such as a rectangle, square, oval, or some other geometric or polygonal shape, etc. The door cover 110 constitutes a front surface of the door 100, and a structure in which the door cover 110 is to be coupled to the glass holder 130, may be formed at a rear surface of the door cover 110.

A structure in which the glass holder 130 is to be coupled to the door cover 110, may be placed at a front surface of the glass holder 130. The glass holder 130 may contact the concave portion 10*a* of the cabinet 10 when the door 100 is closed. A glass rib 141 may be provided at the glass 140 so as to couple the glass 140 to the glass holder 130. Also, a mounting portion 134 on which the glass 140 may be mounted, may be provided at the glass holder 130.

The glass holder 130 may be disposed between the door cover 110 and the glass 140 and may include at least one coupling groove 133 through which the glass holder 130 is to be coupled to the door cover 110. Protrusions provided on the door cover 110 may be coupled to the at least one coupling groove 133 so that the glass holder 130 and the door cover 110 may be coupled to each other. A rib structure may be provided at an inner side of the glass holder 130 so as to reinforce rigidity.

A coupling portion 131 to which a hinge unit 150 is to be coupled, may be provided at one side of the glass holder 130 so that the door 100 may be pivotably installed. Also, a latch 160 for locking the door 100 when the door 100 closes the laundry port may be coupled to the other side of the glass holder 130.

The decoration member 120 may be provided in a ring shape. For example, the decoration member 120 may be provided in a shape which corresponds to a shape of the door. The decoration member 120 may be coupled to the rear surface of the door cover 110. The decoration member 120 may have various colors, and the color of the decoration member 120 may be projected onto the door cover 110 through the first portion 111. According to an embodiment of the disclosure, the decoration member 120 may be formed of a material, such as PMMA or ABS. That is, because the first portion 111 may be transparent, at least a portion of the decoration member 120 may be visible to a user viewing or observing the washing machine from the outside.

Figure 5:
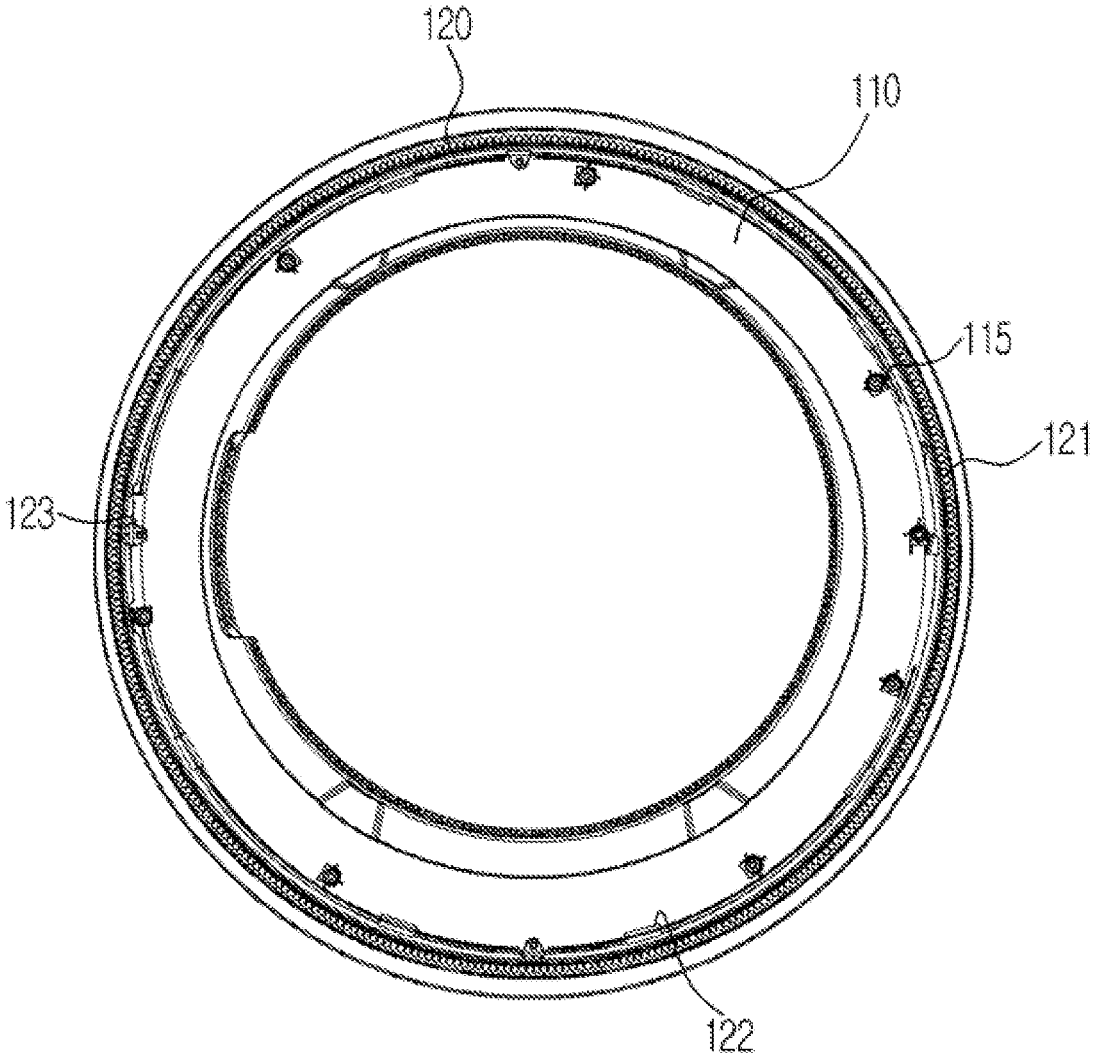
FIG. 5 illustrates a state in which a decoration member is coupled to a door cover, according to an embodiment of the disclosure.
Figure 6:
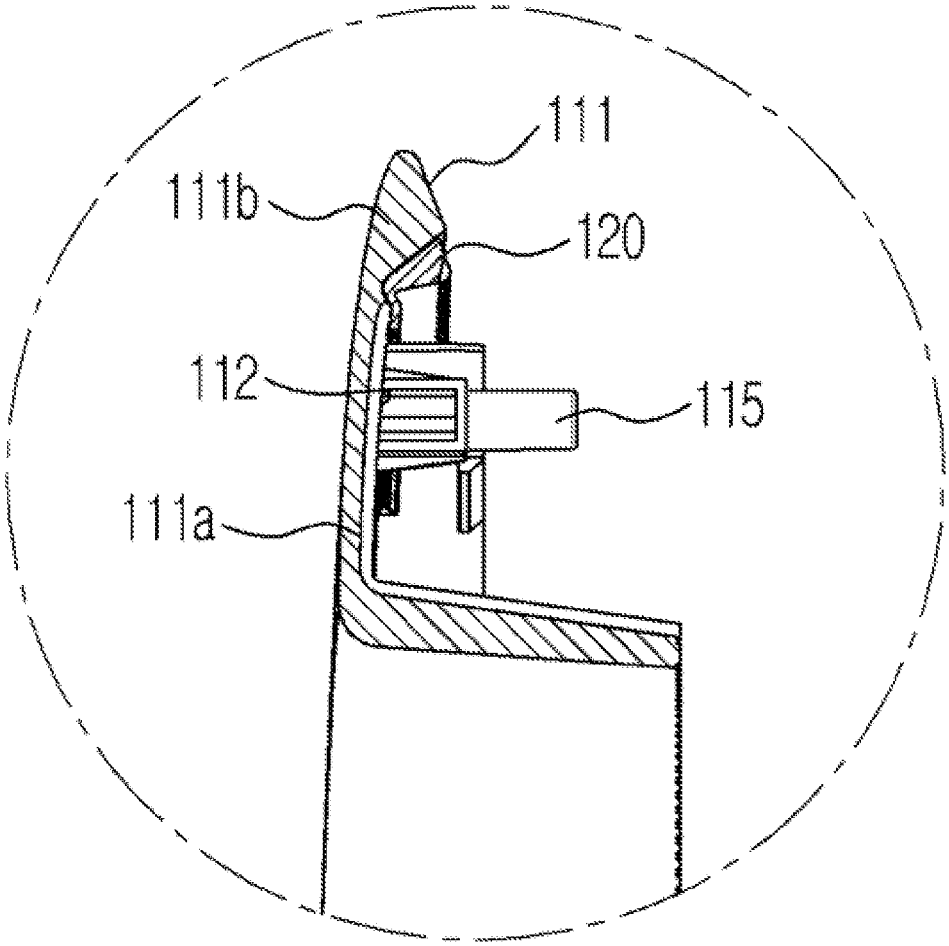
FIG. 6 is a cross-sectional view of a door cover according to an embodiment of the disclosure.
Figure 7:
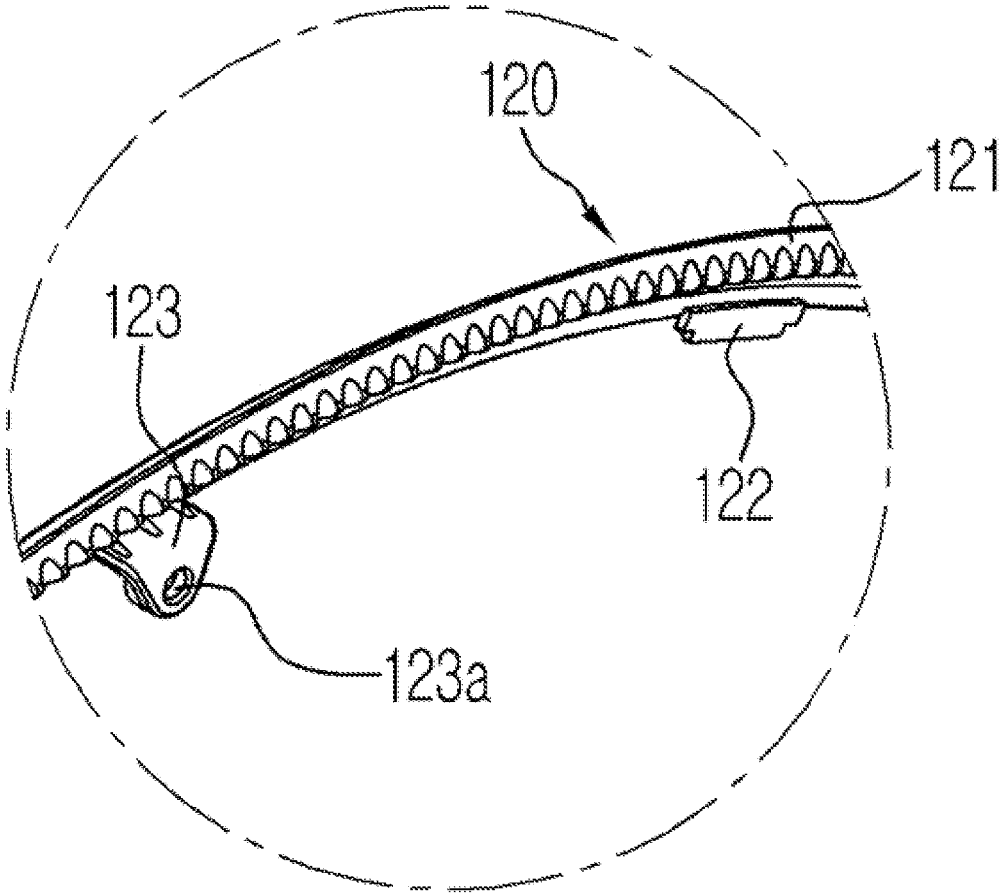
FIG. 7 is an enlarged view of a decoration member according to an embodiment of the disclosure.
Figure 8:
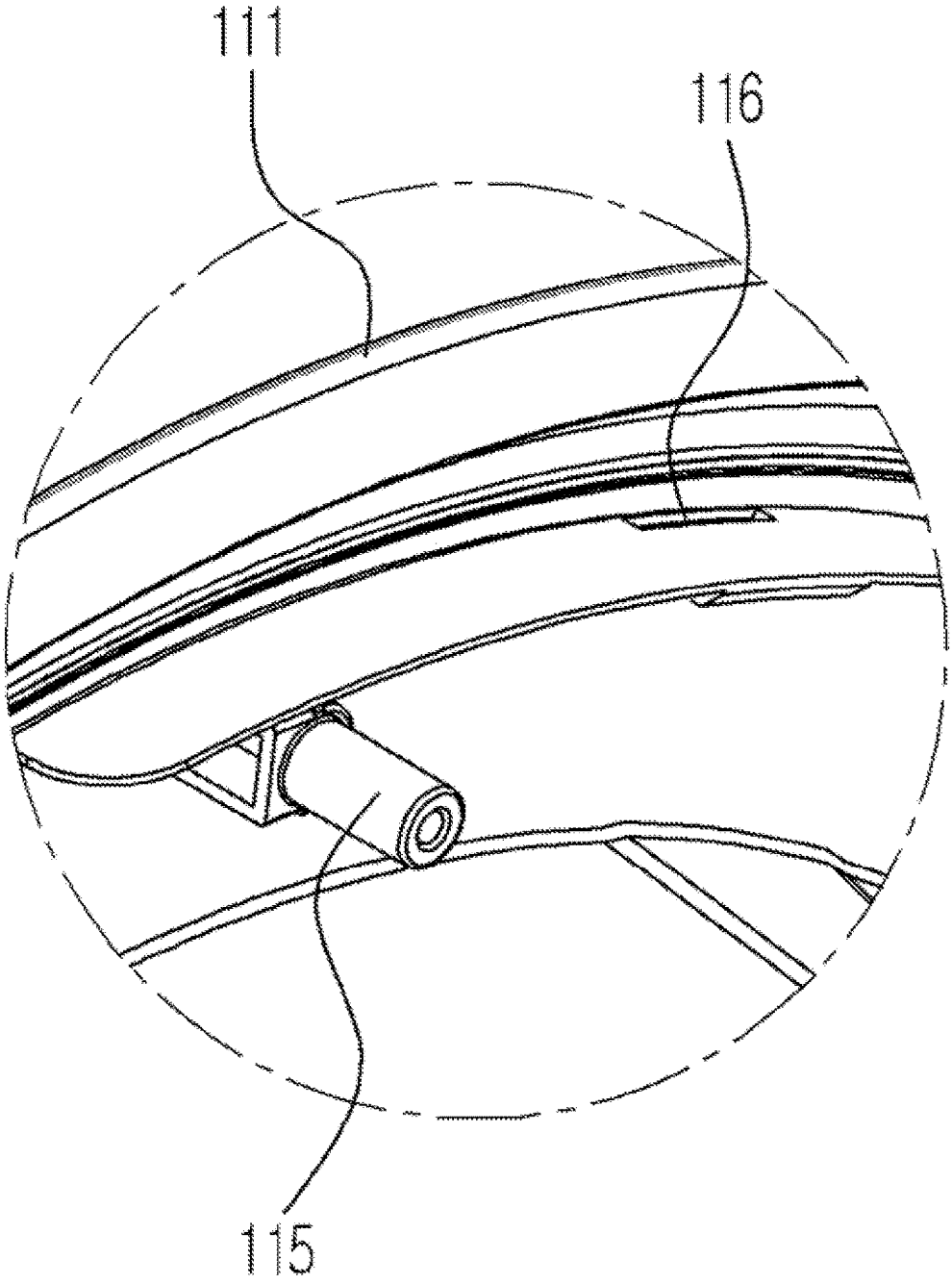
FIG. 8 is an enlarged view of a door cover according to an embodiment of the disclosure.

FIG. 5 illustrates a state in which a decoration member is coupled to a door cover, according to an embodiment of the disclosure, FIG. 6 is a cross-sectional view of a door cover according to an embodiment of the disclosure, FIG. 7 is an enlarged view of a decoration member according to an embodiment of the disclosure, and FIG. 8 is an enlarged view of a door cover according to an embodiment of the disclosure.

As illustrated in FIGS. 5 through 8, the decoration member 120 may be coupled to the rear surface of the door cover 110. The decoration member 120 may be coupled to an inner side of the door cover 110 and thus may be placed to overlap the first portion 111.

The first portion 111 formed of a transparent material may be placed at an outer side of the door cover 110, and the second portion 112 formed of an opaque material may be placed at an inner side of the first portion 111.

The first portion 111 may include a first region 111*a* coupled to the second portion 112 and a second region 111*b* that is not coupled to the second portion 112. Since the first portion 111 may be formed of a transparent material, the second region 111 b that is not coupled to the second portion 112 may be provided transparently. Also, since the first region 111*a* may be coupled to the second portion 112 and the second portion 112 is projected onto the first portion 111, a consumer may view or perceive the first portion 111 onto which the second portion 112 is projected, from the outside of the washing machine 1. The first region 111*a* and the second region 111*b* may be provided in a shape of a concentric circle, and the first region 111*a* may be placed in a center of the concentric circle. For example, first region 111*a* and the second region 111*b* may be provided in a shape which corresponds to a shape of the door. The second region 111*b* is not coupled to the second portion 112, and light incident from the outside of the washing machine 1 may be scattered in the second region 111*b* and thus the light may have a metal color when viewed or observed from the outside of the washing machine 1.

The decoration member 120 may be coupled to the rear surface of the door cover 110 and thus may be placed at the inner side of the door cover 110. The decoration member 120 may be coupled to the first portion 111 and at least a portion of the second portion 112. According to an embodiment of the disclosure, since the second portion 112 may be formed of a colored, opaque material, the portion of the decoration member 120 that overlaps the second portion 112 is not projected onto the door cover 110. The decoration member 120 that is coupled to the second region 111*b* of the first portion 111 may be projected through the second region 111*b*. Since the decoration member 120 may be projected through the second region 111*b*, a color and a material of the decoration member 120 may be visually recognized by a consumer so that a design effect may be achieved without the necessity of performing an additional process. That is, the second region 111*b* may be transparent, at least a portion of the decoration member 120 may be visible to a user viewing the washing machine from the outside.

An inclination portion that is formed to be inclined toward an outer side of the door 100 may be provided on one end of the second region 111*b*. The inclination portion may be formed at edges of the first portion 111. Due to the inclination portion, light may be transmitted through the inclination portion, and a difference in refractive indexes occurs. Thus, a boundary between the first region 111*a* and the second region 111*b* has a metal color due to the difference in refractive indexes.

The decoration member 120 and the door cover 110 may be coupled to each other through hook coupling. Thus, a hook may be provided at at least one of the decoration member 120 and the door cover 110. According to an embodiment of the disclosure, a hook 122 may be provided at the decoration member 120, and a hook coupling portion 116 may be provided at the rear surface of the door cover 110. Alternatively, hook coupling portion 116 may be provided at the decoration member 120, and hook 122 may be provided at the rear surface of the door cover 110.

Also, a fastening member coupling portion 123 may be preparatorily provided at the decoration member 120. The fastening member coupling portion 123 may be used when the decoration member 120 and the door cover 110 are coupled to each other using a fastening member (not shown) instead of (or in addition to) hook coupling. The fastening member coupling portion 123 may be provided to protrude from the decoration member 120 toward an inner side of the door 100. The fastening member (not shown) may be coupled to the fastening member coupling portion 123 including a fastening member coupling hole 123*a*. For example, the fastening member may include bolts, screws, pins, rivets, anchors, or alternatively, adhesives, etc., so long as the desired performance may be achieved.

A plurality of uneven structures 121 may be provided at a rear surface of the decoration member 120. According to an embodiment of the disclosure, circular uneven structures 121 may be provided. The circular uneven structures 121 may be viewed or perceived in various ways according to reflection of light when they are projected through the door cover 110 and are viewed or perceived from the outside of the washing machine 1 by a user, for example.

Also, coupling protrusions 115 may be provided at the rear surface of the door cover 110. The coupling protrusions 115 may be used to be inserted into coupling holes provided at the glass holder 130 so that the door cover 110 and the glass holder 130 may be coupled to each other. However, embodiments of the disclosure are not limited thereto, and the door cover 110 and the glass holder 130 may be coupled to each other using a hook structure, as described above.

Figure 9:
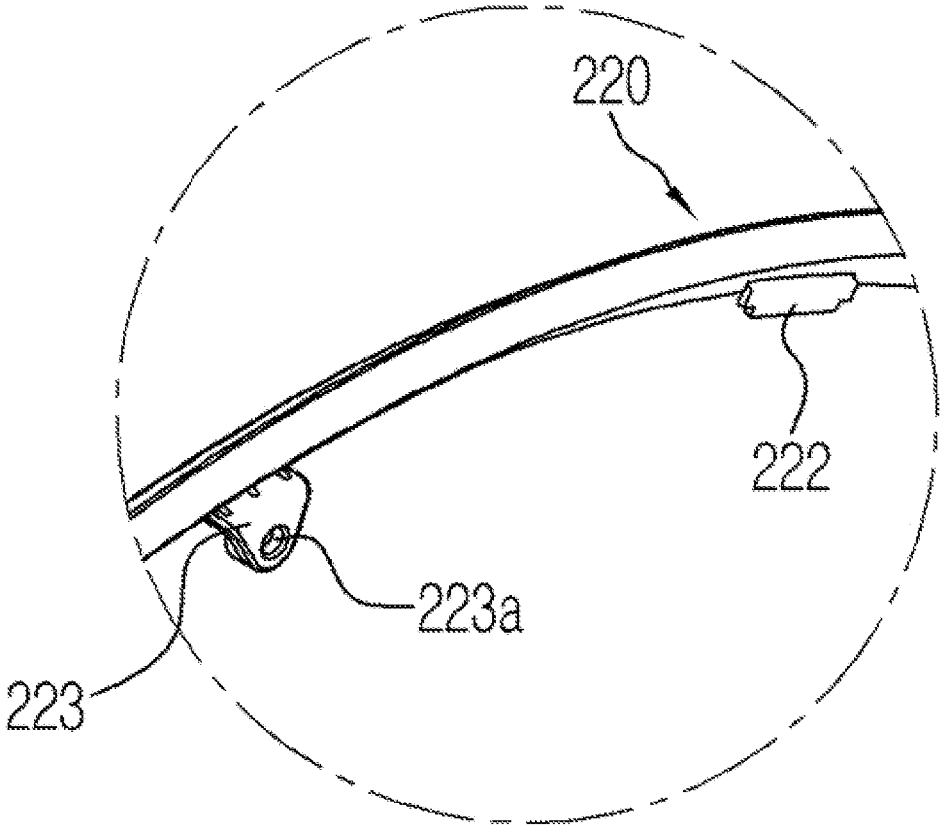
FIG. 9 is an enlarged view of a decoration member according to an embodiment of the disclosure.

FIG. 9 is an enlarged view of a decoration member according to an embodiment of the disclosure.

As illustrated in FIG. 9, no additional uneven structures may also be provided at a decoration member 220. In this case, a hook 222 and a fastening member coupling portion 223 may be provided at the decoration member 220. As such, the decoration member 220 may be modified and applied in various ways, and various beautiful senses may be provided to the door 100 by modifications of the decoration member 220. The fastening member coupling portion 223 may be used when the decoration member 220 and the door cover 110 are coupled to each other using a fastening member (not shown) instead of (or in addition to) hook coupling. The fastening member coupling portion 223 may be provided to protrude from the decoration member 220 toward an inner side of the door 100. A fastening member (not shown) may be coupled to the fastening member coupling portion 223 including a fastening member coupling hole 223*a*. For example, the fastening member may include bolts, screws, pins, rivets, anchors, or alternatively, adhesives, etc., so long as the desired performance may be achieved.

As described above, according to example embodiments of the disclosure, a door may have a decoration characteristic which may be manufactured without the necessity of performing post-processing. The door may be manufactured by performing first injection molding on a first portion 111 of the door cover 110. The first portion 111 may formed of a material such that incident light is able to pass through the first portion 111. The door may be further manufactured by performing secondary injection molding on a second portion 112 of the door cover 110 which is placed at an inner side of the first portion 111 and of which at least a portion is projected through the first portion 111. The decoration member 120 may be coupled to the door cover 110, where at least a portion of the decoration member 120 may be projected through the first portion 111, to the door cover 110. After the coupling of the door cover 110 and the decoration member 120, glass 140 may be coupled to the door cover 110 and decoration member 120. A glass holder 130 for fixing the glass 140 may be coupled to the door cover 110. The coupling of the decoration member 120 and the door cover 110 may be performed using a hook provided at at least one of the decoration member and the door cover.

As described above, according to example embodiments of the disclosure, a door having a decoration characteristic may be manufactured without the necessity of performing post-processing. Furthermore, a structure of a door cover may be improved so that a molding cost may be reduced and simultaneously a door having a decoration characteristic may be manufactured.

The disclosure herein has provided example embodiments of a door included in a washing machine and a method of manufacturing the door. However the disclosure is not limited to particular embodiments described herein. For example, although the door has been described as being applicable to the washing machine shown in FIG. 1, it may be applied to other types of washing machines, for example, a top loading washing machine in which the door may be disposed on a top surface of the washing machine. Further, the door may be applied to other types of machines, for example, an electronic appliance such as a microwave, refrigerator, oven, dryer, and the like.

Although example embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A washing machine, comprising:
a cabinet having a laundry port;
a tub disposed in the cabinet;
a drum disposed in the tub; and
a door that opens and closes the laundry port, the door comprising:
a door cover disposed at an outer side of the door when the door closes the laundry port, the door cover comprising a first portion formed of a transparent material and a second portion disposed at an inner side of the first portion and formed of an opaque material such that at least a part of the second portion is visible through the first portion, and
a decoration member coupled to the door cover such that at least a portion of the decoration member is visible through the first portion.

2. The washing machine of claim 1, wherein the decoration member is coupled to the first portion such that at least a portion of the decoration member overlaps the first portion.

3. The washing machine of claim 2, wherein the decoration member is coupled to a rear surface of the door cover.

4. The washing machine of claim 1, wherein a hook is provided at the decoration member, and a hook coupling portion is provided at a rear surface of the door cover, and
the decoration member and the door cover are coupled to each other by coupling between the hook and the hook coupling portion.

5. The washing machine of claim 1, wherein a fastening member is coupled to a fastening member coupling portion provided at the decoration member to couple the decoration member and the door cover.

6. The washing machine of claim 1, wherein a plurality of uneven structures are provided at the decoration member.

7. The washing machine of claim 1, wherein the door further comprises:
glass disposed in a center of the door; and
a glass holder coupled between the door cover and the glass.

8. A washing machine comprising:
a cabinet having a laundry port;
a tub disposed in the cabinet;
a drum disposed in the tub; and
a door that opens and closes the laundry port, the door comprising:
a door cover disposed at an outer side of the door when the door closes the laundry port, and
a decoration member coupled to the door cover such that at least a portion of the decoration member is visible through the first portion,
wherein
the door cover further comprises a first portion formed of a transparent material and a second portion formed of an opaque material such that at least a part of the second portion is visible through the first portion,
the first portion comprises a first region coupled to the second portion so that the at least the part of the second portion is visible through the first portion, and a second region that is not coupled to the second portion, and
the second region is farther away from a center of the door cover than the first region.

9. The washing machine of claim 8, wherein at least the portion of the decoration member is visible through the second region.

10. A washing machine, comprising:
a cabinet that constitutes an exterior and includes a laundry port;
a tub disposed in the cabinet;
a drum disposed in the tub; and
a door that opens and closes the laundry port, the door comprising:
a door cover comprising a first portion to allow light to pass through at least a portion of the door cover and a second portion disposed at an inner side of the first portion such that at least a part of the second portion is visible through the first portion; and
a decoration member coupled to a rear surface of the door cover such that at least a portion of the decoration member is visible through the first portion.

11. The washing machine of claim 10, wherein the second portion is placed closer to a center of the door cover than the first portion.

12. The washing machine of claim 10, wherein the decoration member is provided in a ring shape.

13. The washing machine of claim 10, wherein the first portion comprises a first region coupled to the second portion and a second region that is not coupled to the second portion.

14. The washing machine of claim 10, wherein a plurality of uneven structures are provided at the decoration member, and the plurality of uneven structures are visible through the first portion.

15. A washing machine comprising:
a cabinet that constitutes an exterior and includes a laundry port;

a tub disposed in the cabinet;

a drum disposed in the tub; and a door that opens and closes the laundry port, the door comprising:

a door cover comprising a first portion to allow light to pass through at least a portion of the door cover and a second portion provided such that at least a portion of the second portion is visible through the first portion, and a decoration member coupled to a rear surface of the door cover such that at least a portion of the decoration member is visible through the first portion, wherein a distance between the decoration member and a center of the door cover is shorter than a distance between the first portion and the center of the door cover and is longer than a distance between the second portion and the center of the door cover.

16. A washing machine comprising:

a cabinet having a laundry port;

a tub disposed in the cabinet;

a drum disposed in the tub; and a door that opens and closes the laundry port, the door comprising:

a door cover disposed at an outer side of the door when the door is closed, the door cover including a first portion formed of a transparent material, and a second portion disposed at an inner side of the first portion and formed of an opaque material such that at least a part of the second portion is visible through the first portion, and a decoration member connected to a rear surface of the door cover, and being partially visible through the first portion from the outer side of the door when the door is closed.

17. The washing machine of claim 16, wherein the first portion is formed as a ring-shaped object, the second portion is formed as a ring-shaped object having a smaller diameter than a diameter of the first portion, and the decoration member is formed as a ring-shaped object and partially overlaps the first portion.

18. A washing machine comprising:

a cabinet having a laundry port;

a tub disposed in the cabinet;

a drum disposed in the tub; and a door that opens and closes the laundry port, the door comprisinq:

a door cover disposed at an outer side of the door when the door is closed ,the door cover including a first portion formed of a transparent material, and a second portion formed of an opaque material, and a decoration member connected to a rear surface of the door cover, and being partially visible from the outer side of the door when the door is closed, wherein the first portion includes:

an inclination portion formed at an outer circumferential edge of the first portion, inclined toward an outer side of the door, a first region coupled to the second portion, the second portion being visible through the first region, and a second region disposed between the inclination portion and the first region to scatter light incident from outside the washing machine and connected to the decoration member.

19. A method of manufacturing a washing machine including a cabinet having a laundry port, a tub disposed in the cabinet, a drum disposed in the tub, and a door for opening and closing a laundry port of the washing machine, the method comprising:

manufacturing a door cover by performing first injection molding on a first portion formed of a transparent material which allows incident light to pass therethrough, and by performing secondary injection molding on a second portion formed of an opaque material which is placed at an inner side of the first portion and of which at least a portion is visible through the first portion;

coupling a decoration member of which at least a portion is visible through the first portion, to the door cover; and coupling the door, which includes the door cover and the decoration member coupled to the door cover, to the laundry port of the washing machine.

20. The method of claim 19, further comprising, after the coupling of the door cover and the decoration member, coupling glass.

21. The method of claim 20, wherein a glass holder for fixing the glass is coupled to the door cover.

22. The method of claim 19, wherein the coupling of the decoration member and the door cover is performed using a hook provided at least one of the decoration member and the door cover.

* * * * *